United States Patent [19]

Kim et al.

[11] Patent Number: 4,831,746

[45] **Date of Patent: * May 23, 1989**

[54] METHOD AND APPARATUS FOR HEATING MINERAL FIBERS

[75] Inventors: Kwan Y. Kim, Greensboro, N.C.; Yee Lee, Reynoldsburg; James S. Belt, Utica, both of Ohio

[73] Assignee: Owens-Corning Fiberglas Corporation, Toledo, Ohio

[ * ] Notice: The portion of the term of this patent subsequent to Apr. 5, 2005 has been disclaimed.

[21] Appl. No.: 120,052

[22] Filed: Nov. 13, 1987

Related U.S. Application Data

[63] Continuation-in-part of Ser. No. 941,659, Dec. 15, 1986, Pat. No. 4,734,996.

[51] Int. Cl.[4] ..... F26B 7/00; F26B 13/10

[52] U.S. Cl. ..... 34/23; 34/41; 34/68; 34/111; 34/216

[58] Field of Search ..... 34/215, 216, 217, 18, 34/23, 41, 68, 111; 432/8, 31, 135

[56] References Cited

U.S. PATENT DOCUMENTS

| | | | |
|---|---|---|---|
| 2,590,757 | 3/1952 | Cornelius, Jr. et al. | 34/13 X |
| 3,069,786 | 12/1962 | Nichols, Jr. | 34/236 |
| 3,865,540 | 2/1975 | Loeffler | 34/16 X |
| 3,925,906 | 12/1975 | Chance et al. | 34/18 |
| 4,192,516 | 3/1980 | McCort | 34/242 |
| 4,326,844 | 4/1982 | Kissell | 432/13 |
| 4,490,927 | 1/1985 | Kissell | 34/155 |
| 4,734,996 | 4/1988 | Kim et al. | 34/23 |

*Primary Examiner*—Steven E. Warner

*Attorney, Agent, or Firm*—Patrick P. Pacella; Ted C. Gillespie

[57] ABSTRACT

A method and apparatus for heating fibrous mineral insulation material comprises an oven divided into zones, a conveyor for carrying the insulation material through the oven, means for directing hot gases into contact with the insulation material in the first oven zone, first heating means for heating the hot gases, and second heating means, distinct from the first heating means and positioned upstream from the first oven zone for heating the conveyor.

20 Claims, 3 Drawing Sheets

METHOD AND APPARATUS FOR HEATING MINERAL FIBERS

This is a continuation-in-part of Ser. No. 941,659, filed Dec. 15, 1986, which is now U.S. Pat. No. 4,734,996, issued Apr. 5, 1988.

TECHNICAL FIELD

This invention pertains to apparatus for heating fibrous mineral material in an oven. More particularly, this invention relates to apparatus for directing hot gases through a fibrous mineral insulation material as the material is passed through an oven in order to dry and/or cure the binder on the insulation material.

BACKGROUND OF THE INVENTION

It is a common practice in the manufacture of mineral fiber insulation to pass the insulation between a pair of foraminous conveyors, or belts, mounted for travel through the curing oven. Hot gases are passed through the insulation to more effectively cure the binder in the insulation. Associated with the oven are supplies of hot drying and curing gases, usually heated air, which travel generally upwardly or downwardly through the insulation material. Typically, the curing ovens are divided into zones, and flexible seals are sometimes used to prevent the curing gases from passing from one zone to an adjacent zone. The common construction for the conveyors is that of apertured flights connected in series and driven by a chain. The ends of the flights are mounted on wheels which ride in tracks running the length of the oven.

One of the problems with ovens for heating mineral material is that the ovens cannot meet the current capacity demands made upon them. Increases in technology and other parts of manufacturing processes, such as the mineral fiber forming portion of the process have enabled increases in line speed which push existing ovens to their capacity. Furthermore, the recent trend in the glass fiber industry, in particular, has been to reduce fiber diameter. This results in a desire to reduce the flow of curing gases in the oven to avoid structural damage to the mineral fiber insulation.

A simple, but expensive, solution is to extend the length of the oven and add one or more additional oven zones. This is, of course, quite expensive, and in some plant facilities it is physically impossible because of space constraints. Another solution is to increase the temperature of the gases in the first oven zone. In many cases however, the high temperature tolerance of the oven conveyor lubricants provide an upper limit on the temperature of curing gases. There is a need for low cost way to improve the efficiency of ovens for drying and curing fibrous insulation material without requiring large amounts of capital or space.

STATEMENT OF THE INVENTION

We have now developed a method and apparatus for improving the efficiency of ovens for heating fibrous mineral insulation material and that is to preheat the conveyors before they travel through the oven with the insulation material to be heated. The hot gases in the first oven zone are working primarily to dry the mineral fiber insulation material. After the material is dried, it is cured, and this usually occurs in a downstream oven zone. We have found that a significant portion of the heat energy of the hot gases flowing in the first oven zone is absorbed by the conveyor itself, thereby reducing the temperature of the hot gases passing through the insulation material. By raising the temperature of the oven conveyor prior to the time it enters the first oven zone, the conveyor itself will not be robbing the hot gases of their heat, and the hot gases will do a more efficient job of drying and curing the pack in the first oven zone.

According to this invention, there is provided apparatus for heating fibrous mineral insulation material comprising an oven divided into zones, a conveyor for carrying the insulation material through the oven, means for directing hot gases into contact with the insulation material in the first updraft oven zone, first heating means for heating the hot gases, and second heating means, distinct from the first heating means and positioned upstream from the first updraft oven zone, for heating the conveyor. In the broadest sense, the invention comprises the heating of either the top or bottom conveyor prior to the time that that particular conveyor (top or bottom) enters an oven zone where that conveyor is the first conveyor met by the hot gases before the hot gases pass through the insulation material, i.e., heating the top conveyor prior to the time it enters the first downflow oven zone, or heating the bottom conveyor piror to the time it enters the first upflow oven zone.

In a specific embodiment of the invention, the conveyor comprises an insulation contact surface and a framework, and the second heating means is adapted to heat the contact surface substantially without heating of the framework.

In a preferred embodiment of the invention, the second heating means is an induction heater.

According to this invention, there is provided a method for heating fibrous mineral insulation material comprising carrying the insulation material through an oven divided into zones, heating gases with a first heating means, directing the hot gases into contact with the insulation material in the first updraft oven zone, and heating the conveyor with a second heating means which is distinct from the first heating means and positioned upstream from the first updraft oven zone.

In a specific embodiment of the invention, the conveyor comprises an insulation contact surface and a framework, and the second heating means heats the contact surface without substantial heating of the framework.

DESCRIPTION OF THE INVENTION

This invention will be described with reference to apparatus for curing fibrous glass insulation material, although it is to be understood that the invention can be practiced for heating, drying, or curing other heat soft-enable mineral materials, such as rock, slag and basalt.

Figure 1:
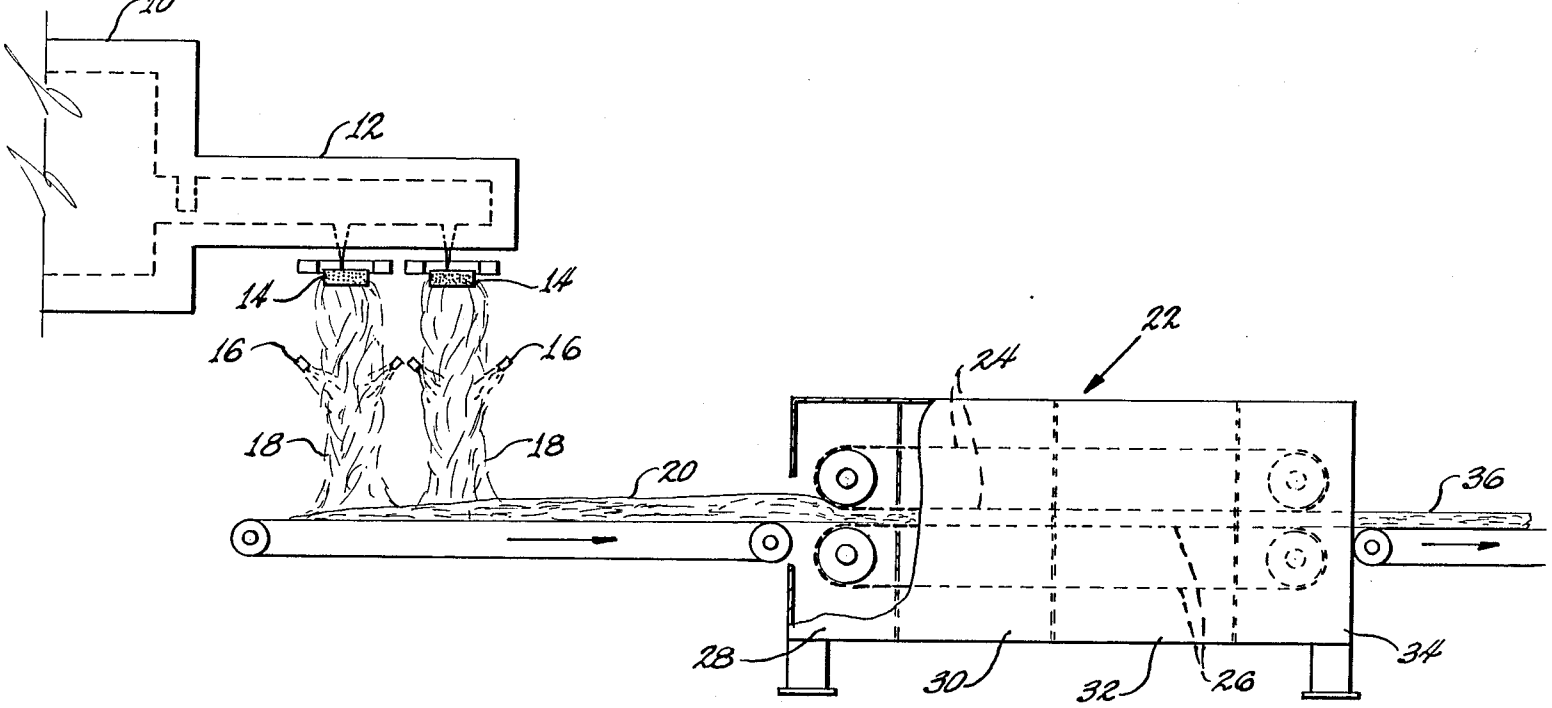
FIG. 1 is a schematic cross-sectional view in elevation of the apparatus for heating fibrous mineral insulation material according to the principles of this invention.

Referring to FIG. 1 it can be seen that molten glass is supplied from furnace 10 via forehearth 12 to fiberizers 14. Veils of fibers 18 produced by the fiberizers are sprayed by binder applicators 16, and the fibers are collected as uncured wool pack 20. The binder can be a phenol formaldehyde binder, or any other type of binder. It is to be understood that the pack can be produced by alternate methods, many of which are known in the art. The uncured pack is then passed through oven 22 while the pack is sandwiched between top conveyor 24 and bottom conveyor 26. The oven is preferably a multi-zone oven having two or more oven zones, and preferably contains an entrance vestibule and an exit vestibule. As shown, the oven in FIG. 1 contains entrance vestibule 28, first updraft oven zone 30, second updraft oven zone 32 and exit vestibule 34. The uncured wool passing through the oven is dried in the first oven updraft zone and then cured by the hot gases passing through the conveyor and through the insulation product. The cured insulation product exiting the oven is dried and cured insulation product 36.

Figures 2, 3:
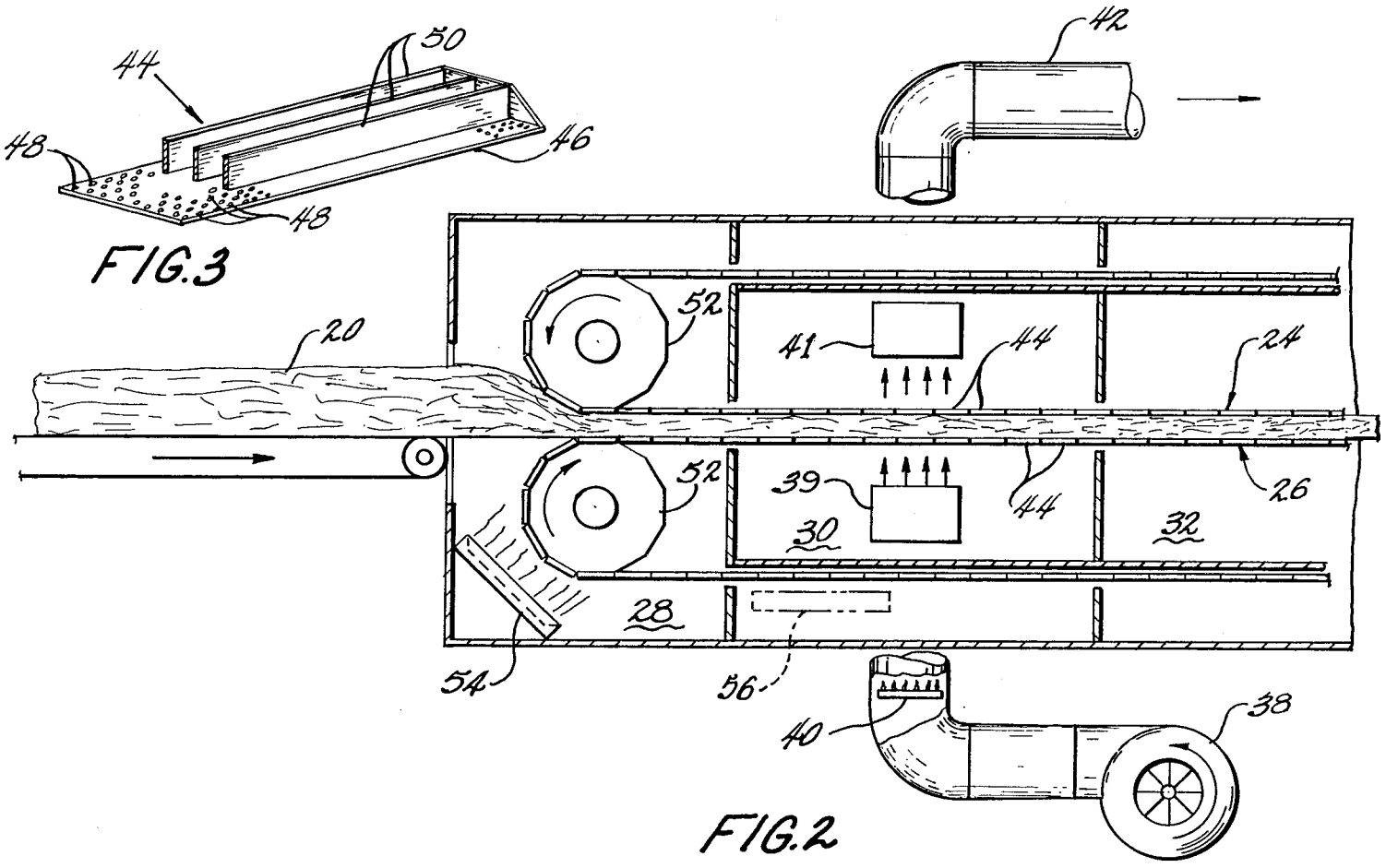
FIG. 2 is a schematic cross-sectional view in elevation of the entrance vestibule and the first oven zone of the oven of FIG. 1.
FIG. 3 is a schematic isometric view of an oven flight of the oven conveyor.

Each zone of the oven can be adapted with a hot gas flow apparatus for forcing hot gases through the insulation product. As shown in FIG. 2, the first updraft oven zone is adapted with curing gas fan 38 for forcing the curing air into the oven. The gases enter the oven through any appropriate means, such as inlet duct 39. Any suitable means for heating the curing and drying gases, such as burner 40, can be used to raise the temperature of the hot gases. The gases are forced through the bottom conveyor, the insulation product, and the top conveyor, as indicated by the arrows. The hot gases are removed from the first updraft oven zone through outlet duct 41 by any suitable means, such as oven exhaust 42.

Any conveyor means suitable for carrying the uncured pack through the oven, while enabling the flow of curing gases through the pack, can be used for the conveyors. The conveyors are mounted for travel through the oven on any suitable apparatus, such as wheels 52, and can be driven by any conventional means, not shown. As shown in FIGS. 2 and 3, the conveyor belts can be comprised of a plurality of flights 44. The flights can be comprised of screens or perforated plates, such as insulation contact surface 46. Apertures 48 in the insulation contact surface enable the curing gases to flow through the flights and through the insulation material. The flights also comprise non-perforated portions or framework 50 for providing the structure of the flight. Typically, the mass of the insulation contact surface will be a small fraction of the total mass of the flight.

In addition to the burner 40 for heating the curing gases, there is provided a second heat source, such as induction heater 54, for heating the flights of the bottom conveyor just before they contact the uncured wet wool. This second heating means can be any means suitable for raising the temperature of the conveyor flights. For example, a gas burner could be employed. In a typical oven, the curing gases are delivered to the first zone at a temperature of approximately 550° F. to 600° F., although the temperature can be lower. The bottom conveyor in a typical prior art oven enters the first updraft zone at a temperature of approximately 350° F. to 400° F. As the curing and drying gases flow through the bottom conveyor, heat transfer between the curing gases and the bottom conveyor raises the temperature of the bottom conveyor and lowers the temperature of the curing gases. As a result of this, the efficiency of the first oven zone is reduced.

By raising the temperature of the conveyors according to this invention at a position upstream from the first oven zone, this heat transfer within the first oven zone between the gases and the flights, is substantially reduced and the hot gases reaching the uncured wet wool will be closer to the input temperature. Typically the temperature of the flights is raised between 30° F. and 60° F., although lesser or greater amounts of temperature change could be used. By preheating the flights before they enter the first oven zone, the hot gases can dry the uncured wet wool faster and begin curing the wool sooner. It is believed that the addition of the preheating apparatus may be the equivalent of adding an entire oven zone in a multi-zone oven. The effect of flight preheating may increase the efficiency of the second zone also. The total benefit of one oven equipped with the preheating apparatus was a 10% increase in the overall capacity of the oven.

An additional feature is presented when the second heating means is an induction heater, such as induction heater 54. The induction heater can be adapted to merely raise the temperature of the insulation contact surface of the flights, without substantially raising the temperature of the framework 50. Since only a small fraction of the mass of the flight is being preheated, this saves a considerable portion of the energy of the induction heater. Since most of the undesired heat transfer between the hot gases and a relatively cold flight occurs at the insulation contact surface, it is been found to be not as critical to heat the framework. Heat transferred from the hot gases to the framework is not that great due to the limited surface area of the framework. It has been found that the use of preheating equipment for the flights can enable a reduction in the gas temperature of the hot gases in both the first and second oven zones of a multi-zone oven.

The induction heater can be of any type suitable for heating the oven flights, many types of which are commercially available. An induction heater which has been used successfully is I.E.H. Company 400 kw induction heater Model IEH-05-400-03, Warren, Ohio.

It is to be understood that the advantage of the invention can be taken either in reduced gas usage for the first and second oven zones, or in increased throughput by increasing the line speed of the wool passing through the oven, or a combination of the two.

The induction heater can also be positioned upstream from the wheels, such as induction heater 56 shown in phantom lines, to avoid applying heat to the area surrounding the wheels.

Figure 4:
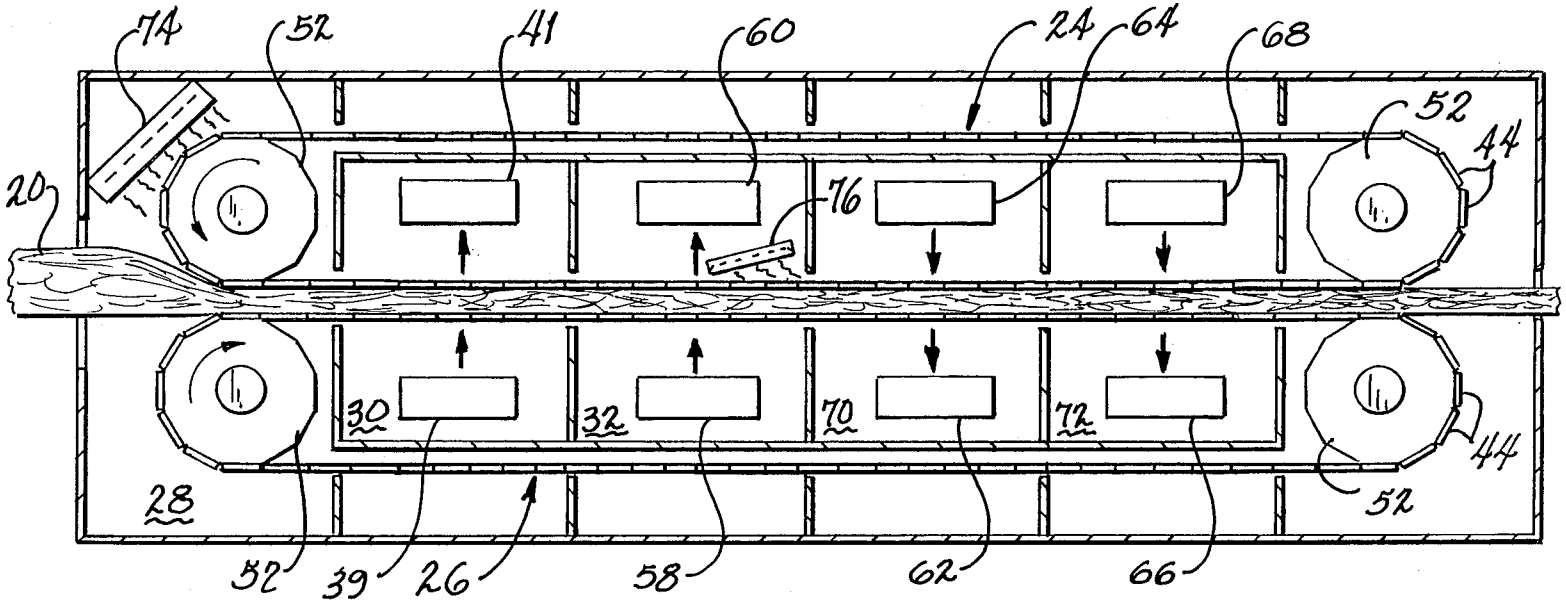
FIG. 4 is a schematic cross-sectional view in elevation of a 4-zone oven similar to the oven of FIGS. 1 and 2.

It should also be understood that the heater for the oven flights can be positioned to heat the flights of the top coneyor at a position upstream from the first downdraft oven zone. For example, the heater could be positioned upstream from the first oven zone to heat the flights of the top conveyor just before it enters the first oven zone. As shown in FIG. 4, zones 30 and 32 are updraft zones, having inlet ducts 39 and 58, and outlet ducts 41 and 60, respectively. The supply and exhaust ducts are not shown for purposes of clarity. Downdraft zones 70 and 72 have inlet ducts 64 and 68, and outlet ducts 62 and 66, respectively.

Heater 74 can be positioned upstream from the first oven zone to heat top conveyor 24. Alternatively, heater 76 can be positioned immediately upstream from the first downdraft oven zone, i.e., zone 70, to heat the flights 44 of the top conveyor. In either case, the heater (74 or 76) is positioned upstream from the first downdraft zone 70.

In the broadest sense, the invention comprises the heating of either the top or bottom conveyor prior to the time that that particular conveyor (top or bottom) enters an oven zone where that conveyor is the first conveyor met by the hot gases before the hot gases pass through the insulation material, i.e., heating the top conveyor prior to the time it enters the first downflow oven zone, or heating the bottom conveyor prior to the time it enters the first upflow oven zone. Of course, both top and bottom heating can be used at the same time.

Various modifications of the above described embodiments of the invention will be apparent to those skilled in the art, and it is to be understood that such modifications can be made without departing from the scope of the invention.

What is claimed:

1. Apparatus for heating fibrous mineral insulation material comprising an oven divided into two or more zones, a conveyor for carrying the insulation material through the oven, means for directing hot gases into contact with the insulation material in the first updraft oven zone, first heating means for heating the hot gases, and second heating means, distinct from the first heating means and positioned upstream from the first updraft oven zone, for heating the conveyor.

2. The apparatus of claim 1 in which the second heating means is an induction heater.

3. Apparatus for heating fibrous mineral insulation material comprising an oven divided into two or more zones, a conveyor for carrying the insulation material through the oven, means for directing hot gases into contact with the insulation material in the first downdraft oven zone, first heating means for heating the hot gases, and second heating means, distinct from the first heating means and positioned upstream from the first downdraft oven zone, for heating the conveyor.

4. The apparatus of claim 3 in which the second heating means is an induction heater.

5. The method for heating fibrous mineral insulation material comprising carrying the insulation material on a conveyor through an oven divided into two or more zones, heating gases with a first heating means, directing the hot gases upwardly into contact with and through the insulation material in the first updraft oven zone, and heating the conveyor with a second heating means which is distinct from the first heating means and positioned upstream from the first updraft oven zone.

6. The method of claim 5 in which the second means is an induction heater.

7. The method of claim 5 in which the conveyor comprises an insulation contact surface and a framework, and the second heating means heats the contact surface without substantial heating of the framework.

8. The method of claim 7 in which the second heating means is an induction heater.

9. The method for heating fibrous mineral insulation material comprising carrying the insulation material in contact with a conveyor through an oven divided into two or more zones, heating gases with a first heating means, directing the hot gases downwardly into contact with and through the insulation material in the first downdraft oven zone, and heating the conveyor with a second heating means which is distinct from the first heating means and positioned upstream from the first downdraft oven zone.

10. The method of claim 9 in which the second means is an induction heater.

11. The method of claim 10 in which the conveyor comprises an insulation contact surface and a framework, and the second heating means heats the contact surface without substantial heating of the framework.

12. The method of claim 11 in which the second heating means is an induction heater.

13. In apparatus for heating fibrous mineral insulation material of the type in which an oven is divided into two or more zones, top and bottom conveyors are mounted to sandwich the insulation material therebetween and carry it through the oven, and a first heating means is adapted to heat gases and direct them upwardly into contact with and through the insulation material in the first updraft zone, the improvement comprising a second heating means which is distinct from the first heating means and which is adapted to heat the bottom conveyor at a position upstream from the first updraft zone.

14. The apparatus of claim 13 in which the second heating means is an induction heater.

15. In apparatus for heating fibrous mineral insulation material of the type in which an oven is divided into two or more zones, top and bottom conveyors are mounted to sandwich the insulation material therebetween and carry it through the oven, and a first heating means is adapted to heat gases and direct them downwardly into contact with and through the insulation material in the first downdraft zone, the improvement comprising a second heating means which is distinct from the first heating means and which is adapted to heat the top conveyor at a position upstream from the first downdraft zone.

16. The apparatus of claim 15 in which the second heating means is an induction heater.

17. In the method for heating fibrous mineral insulation material of the type in which the insulation material is carried through an oven, which is divided into two or more zones, by top and bottom conveyors which sandwich the insulation material therebetween, oven gases are heated with a first heating means, and the heated gases are directly upwardly into contact with and through the insulation material in the first updraft zone, the improvement comprising heating the bottom conveyor at a position upstream from the first updraft zone with a second heating means which is distinct from the first heating means.

18. The method of claim 17 in which the second heating means is an induction heater.

19. In the method for heating fibrous mineral insulation material of the type in which the insulation material is carried through an oven, which is divided into two or more zones, by top and bottom conveyors which sandwich the insulation material therebetween, oven gases are heated with a first heating means, and the heated gases are directed downwardly into contact with and through the insulation material in the first downdraft zone, the improvement comprising heating the top conveyor at a position upstream from the first downdraft zone with a second heating means which is distinct from the first heating means.

20. The method of claim 19 in which the second heating means is an induction heater.

* * * * *